US006314966B1

(12) United States Patent
Yokokawa

(10) Patent No.: US 6,314,966 B1
(45) Date of Patent: Nov. 13, 2001

(54) HAIR WINDING DEVICE FOR USE IN HAIR PERMANENT PROCESS WITH SEQUENTIAL HAIR-HOLDING AND TWISTING OPERATION

(75) Inventor: Ritsu Yokokawa, Osaka (JP)

(73) Assignee: Discovery Co., Ltd., Osaka-hu (JP)

( * ) Notice: Subject to any disclaimer, the term of this patent is extended or adjusted under 35 U.S.C. 154(b) by 0 days.

(21) Appl. No.: 09/518,728

(22) Filed: Mar. 3, 2000

(30) Foreign Application Priority Data

Jun. 30, 1999 (JP) ..... 11-185469

(51) Int. Cl.[7] ..... A45D 24/00
(52) U.S. Cl. ..... 132/148; 132/212
(58) Field of Search ..... 132/148, 144, 132/271, 238, 242, 277, 226, 264, 265, 119.1, 212, 232, 112

(56) References Cited

U.S. PATENT DOCUMENTS

| | | | | |
|---|---|---|---|---|
| 1,293,304 | * | 2/1919 | Beard | 132/238 |
| 2,209,697 | * | 7/1940 | Kislingbury et al. | 132/277 |
| 2,524,058 | * | 10/1950 | Kamara | 132/271 |
| 3,605,762 | * | 9/1971 | Fromman | 132/226 |
| 5,119,847 | * | 6/1992 | Powell et al. | 132/226 |
| 5,603,339 | * | 2/1997 | Brazeal et al. | 132/119.1 |
| 5,865,193 | * | 2/1999 | Fukumoto | 132/238 |

FOREIGN PATENT DOCUMENTS

| | | |
|---|---|---|
| 2-26401 | 7/1990 | (JP) . |
| 08182531 | 7/1996 | (JP) . |
| 10-033241 | 2/1998 | (JP) . |

* cited by examiner

*Primary Examiner*—Pedro Philogene
(74) *Attorney, Agent, or Firm*—Rabin & Berdo, P.C.

(57) ABSTRACT

A rotating member is connected through a motor shaft to a motor provided in a housing of the body. A clip is composed of a first holding member and a second holding member, which are energized so that their respective ends are pressed against each other. The first holding member is attached to the end of the rotating member in the direction of the center of its rotating axis. When a switch is turned on in this condition, the rotation of the rotating member is transferred to the first holding member and the clip turns in a prescribed direction. Accordingly the hair held at the end of the clip is twisted at a designated speed in a prescribed direction.

11 Claims, 8 Drawing Sheets

HAIR WINDING DEVICE FOR USE IN HAIR PERMANENT PROCESS WITH SEQUENTIAL HAIR-HOLDING AND TWISTING OPERATION

BACKGROUND OF THE INVENTION

1. Field of the Invention

The present invention relates to a hair winding device for use in hair permanent process, and particularly to a hair winding device for use in special hair permanent process such as spiral permanent etc.

2. Description of the Background Art

FIG. 7 is a diagram schematically showing the structure of the hair winding device for use in hair permanent process described in U.S. Pat. No. 5,865,193.

Referring to this diagram, the body 17 to be held with the hand contains a motor 21 inside, and the motor 21 has a motor shaft 22 to which a rod engaging member 61 is detachably connected. The motor 21 is driven when a switch (not shown) is depressed and then the rod engaging member 61 is driven and starts rotating through the motor shaft 22.

FIG. 8 is a diagram showing the perm-dressing hair winding device of FIG. 7 with a perm-dressing rod 62 attached to the rod engaging member 61.

Referring to this diagram, the motor 21 in the body 17 is driven to cause the rod 62 to rotate, and thus the hair to be processed can be wound on the rod 62 in a shorter time than by handwork. In this way, even an unskilled person can easily wind hair in a short time prior to the application of a cold permanent 71 to curl the hair as shown in FIG. 9.

However, although the perm-dressing hair winding device described above is useful for common permanent waves, it is difficult to use this hair winding device in the process of applying a special permanent such as the spiral permanent.

FIG. 10 shows hair processed by a spiral permanent.

Referring to the diagram, the process of applying such a spiral permanent wave 72 includes: slicing the hair in blocks, twisting every several tens of the sliced hairs into a strand, further twisting every several strands together as shown in the diagram, and applying a permanent treatment to the hair.

While applying the spiral permanent requires the process of twisting the hair, the perm-dressing hair winding device can only wind the hair in a given direction. Accordingly, when applying a special permanent such as the spiral permanent that requires twisting the hair or winding the hair into small spirals, the preparatory process must be performed manually, which is actually a time-consuming work even for a skilled worker.

SUMMARY OF THE INVENTION

The present invention has been made to solve the problems described above, and an object of the invention is to provide a hair winding device for use in hair permanent process which allows accurate hairdressing to be done in a shorter time in the process of applying a special permanent like spiral permanent that requires twisting hair, for example.

To achieve the object above, a hair winding device for use in hair permanent process according to a first aspect of the invention comprises: holding means for holding end of hair to be processed; and rotating means for rotating the holding means in such a direction that the held hair is twisted.

With this structure, the hair can be twisted between the roots and the ends.

According to a hair winding device for use in hair permanent process of a second aspect of the invention, in the structure of the first aspect, the holding means comprises a clip, the clip including a first holding member, a second holding member connected to the first holding member through a shaft and capable of turning on the shaft, and energizing means for energizing the first holding member and the second holding member in such a direction that their respective ends are pressed against each other, the first holding member being connected to the rotating means so that the first holding member rotates around its own axial direction.

With this structure, the end of the hair is held between the end of the first holding member of the clip and the end of the second holding member and the hair is twisted in this condition.

According to a hair winding device for use in hair permanent process of a third aspect of the invention, in the structure of the second aspect, the rotating means comprises a motor and a rotating member connected to a rotating shaft of the motor, and the first holding member is connected to the rotating member with its center of rotation aligned with the axis of rotation of the rotating member.

With this structure, the held hair can be twisted in the held position without shaking.

According to a hair winding device for use in hair permanent process of a fourth aspect of the invention, in the structure of the second aspect or the third aspect, the ends of the first holding member and the second holding member are covered with caps composed of an elastic material to more tightly hold the hair.

With this structure, the hair can be held by the clip more tightly.

According to a fifth aspect of the invention, a hair winding device for use in hair permanent process comprises: rod-like winding means on which hair to be processed can be spirally wound; holding means for holding an end of the winding means; and rotating means for rotating the holding means so as to rotate the held winding means around its own axis.

With this structure, the hair can be spirally and continuously wound on the winding means.

According to a sixth aspect of the invention, a hair winding device for use in hair permanent process for holding hair to be processed and twisting the hair comprises: a clip comprising a first holding member and a second holding member connected to the first holding member through a shaft and capable of turning on the shaft, and energized in such a direction that their respective ends are pressed against each other; a rotating member connected to the first holding member with its axis of rotation aligned with the axis of the first holding member; and a motor for rotating the rotating member.

With this structure, the hair can be held between the end of the first holding member and the end of the second holding member of the clip and twisted in this condition.

As stated above, according to the hair winding device for use in hair permanent process of the first aspect, the hair can be twisted between the roots and the ends and thus the hair can be twisted in a stable manner.

According to the hair winding device for use in hair permanent process of the second aspect, in addition to the effect of the first aspect, the rotating power of the rotating means can be effectively transferred through the first holding member in such a direction that the hair is twisted.

According to the hair winding device for use in hair permanent process of the third aspect, in addition to the effect of the second aspect, the held hair can be twisted in that position without shaking, and thus the hair can be twisted in a more stable manner.

According to the hair winding device for use in hair permanent process of the fourth aspect, in addition to the effect of the second aspect or the third aspect, the clip can hold the hair more tightly so that the hair can be twisted under stable tension, which enables the hair to be arranged more neatly.

According to the hair winding device for use in hair permanent process of the fifth aspect, the hair can be wound on the winding means spirally and continuously, so that the hair can be wound into spirals with desired winding diameter in a shorter time and in a stable manner.

According to the hair winding device for use in hair permanent process of the sixth aspect, the rotating power of the motor can be transferred to the first holding member through the rotating member so that the held hair can be twisted in a stable manner.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
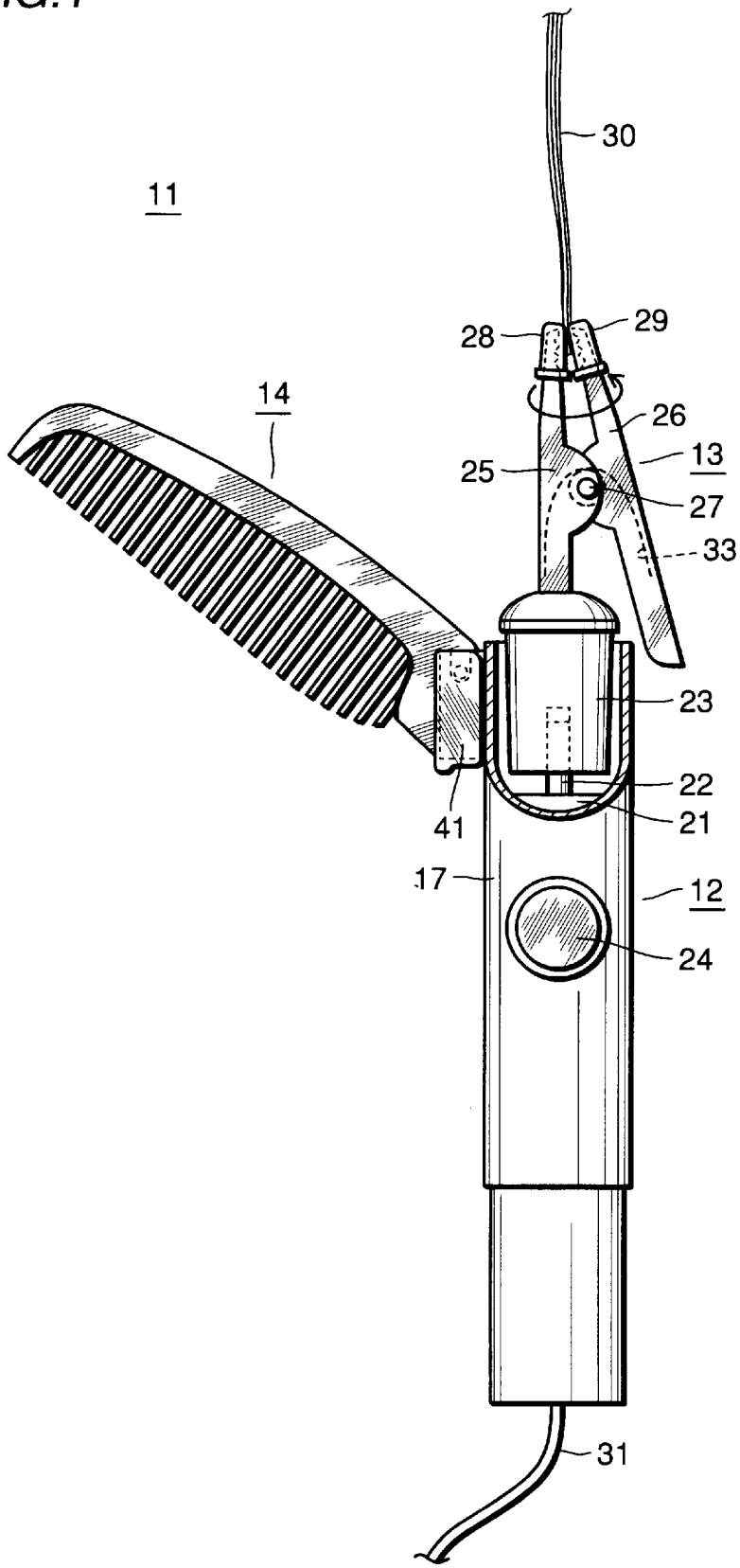
FIG. 1 is a diagram schematically showing the structure of a hair winding device for use in hair permanent process according to a first embodiment of the present invention.

FIG. 1 is a diagram schematically showing the structure of a hair winding device for use in hair permanent process according to a first embodiment of the invention. This diagram shows the body in a partially cutaway manner.

Referring to this diagram, the perm-dressing hair winding device 11 includes the body 12 held by a hairdresser with the hand, a clip 13 attached to an end of the body 12, and a comb 14 attached to the side of the body 12 near the end. Specifically, the body 12 is composed of a tube-like housing 17, a motor 21 contained inside the housing 17, and a rotating member 23 detachably fixed to the motor shaft 22 of the motor 21.

The motor 21 is supplied with power through a power-supply cord 31 connected to the rear end of the housing 17, and which is controlled to rotate and stop as a switch 24 provided approximately in the middle of the housing 17 is turned on/off.

The clip 13 is composed of a rod-like first holding member 25 and a rod-like second holding member 26 connected to the first holding member 25 through a pivot 27 and capable of turning on the pivot 27. The first holding member 25 and the second holding member 26 are energized by energizing means, e.g. a spring 33, attached around the pivot 27 in such a direction that their respective ends are pressed against each other. The rear part of the first holding member 25 is detachably attached to the rotating member 23, so that the first holding member 25 rotates around its axial direction as the rotating member 23 rotates.

The first holding member 25 and the second holding member 26 have notches near the ends to hold the end of hair 30 to be processed. In this embodiment, the notched parts are covered with a first cap 28 and a second cap 29 made of an elastic material such as rubber in order to hold the hair 30 more tightly.

The comb 14 used to tidy and arrange the hair in the hairdressing process is detachably fitted to the housing 17 of the body 12 through a fitting member 41. The structure for the attachment will be described in detail later.

Figure 2:
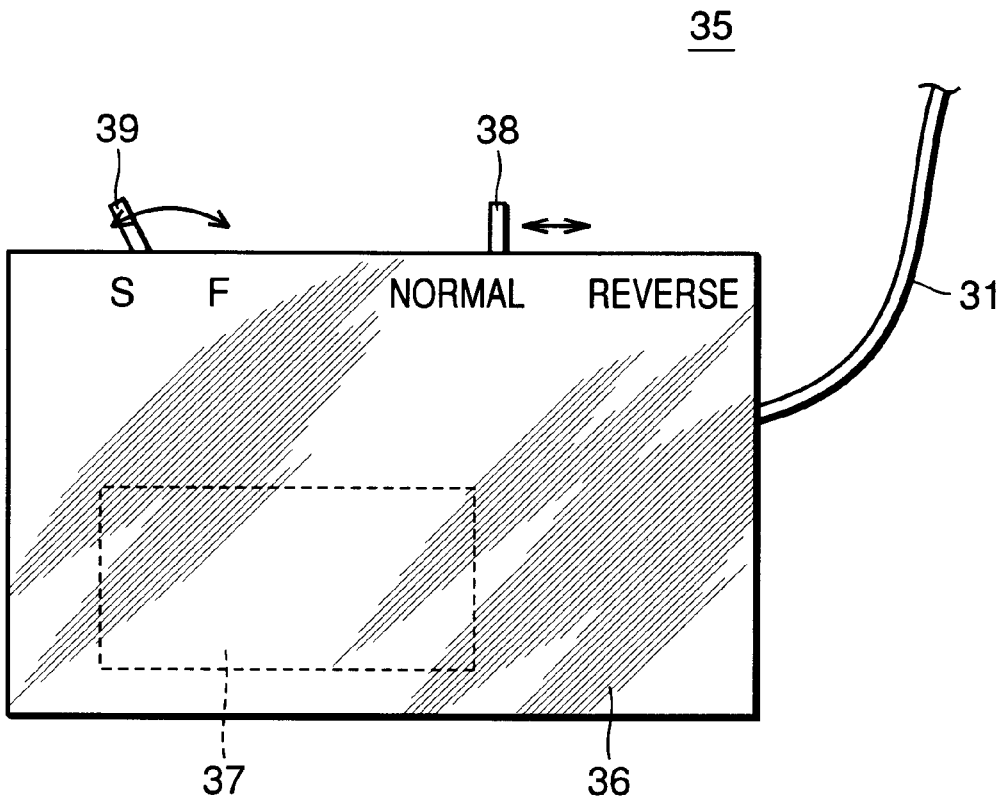
FIG. 2 is a diagram schematically showing the structure of a controller for controlling the rotating speed and the like of the perm-dressing hair winding device shown in FIG. 1.

FIG. 2 is a diagram schematically showing the structure of a rotation controller connected to the perm-dressing hair winding device 11 shown in FIG. 1 in order to supply power to it.

Referring to the diagram, its body 36 which is shaped like a rectangular box and to which the power-supply cord 31 is connected contains a battery 37. A clip (not shown), for example, is attached to the body 36 so that the hairdresser can carry it on his/her belt, for example. The body 36 has a rotating direction changing switch 38 on its upper surface, which is operated to control the direction of rotation of the motor 21 shown in FIG. 1.

The body 36 also has on its upper surface a rotating speed changing switch 39 for controlling the magnitude of the voltage supplied to the motor 21. More specifically, turning the rotating speed changing switch 39 to "F," side causes the supply voltage to the motor 21 to rise to increase the speed of rotation of the motor 21, and turning it to "S" side slows down the rotating speed of the motor 21. Thus the rotating speed of the motor 21 can be controlled to desired speed by operating the rotating speed changing switch 39.

Next, a method for using the perm-dressing hair winding device 11 of this embodiment will be described.

When applying a permanent which requires twisting, such as the spiral permanent, the hair to be processed is sliced in blocks and the sliced hair 30 is held between the ends of the clip 13. More specifically, the rear part of the second holding member 26 of the clip 13 is depressed. That is to say, a force is applied to separate the ends of the first holding member 25 and the second holding member 26 from each other. As the first cap 28 and the second cap 29 are thus separated apart, the end of the hair 30 is set between them, and then the force applied to the second holding member 26 is removed to hold the end of the hair 30 with the clip 13.

In this condition, the switch 24 is depressed and turned on. Then the motor 21 is driven to cause the rotating member 23 to rotate through the motor shaft 22. Since the first holding member 25 of the clip 13 is connected in such a way that its axial direction is aligned with the center of the rotation axis of the rotating member 23, the first holding member 25 rotates around the center of its own axis. Then, since the second holding member 26 is connected to the first holding member 25 through the pivot 27, the clip 13 turns as one unit in the direction shown by the arrow.

Thus the hair 30 held at the end of the clip 13 is twisted in the direction shown by the arrow. Since the time period in which it is twisted corresponds to the ON state of the switch 24, the switch 24 is released from depression and turned off when a designated twisting has been done. Thus the process of twisting the hair 30 is controlled by the rotation of the motor 21, so that the hair 30 can be arranged in a stable manner with a constant twisting force.

While the description above has shown an example in which the switch 24 is turned on to twist the hair 30 in the arrow direction, turning the rotating direction changing switch 38 of the rotation controller 35 shown in FIG. 2 from "normal rotation" to "reverse rotation" causes the motor to rotate in the reverse direction. Accordingly, if the hair 30 was twisted more than necessary, the clip 13 can be reversely turned by operating the rotating direction changing switch 38 to cancel the excess twisting by a given quantity, which improves the convenience in use.

Further, the rotating speed of the clip 13 can be controlled by setting the rotating speed changing switch 39 of the rotation controller 35 shown in FIG. 2 to a desired position between "S" and "F," which allows the speed of twisting the hair 30 to be finely and easily controlled.

Figure 3:
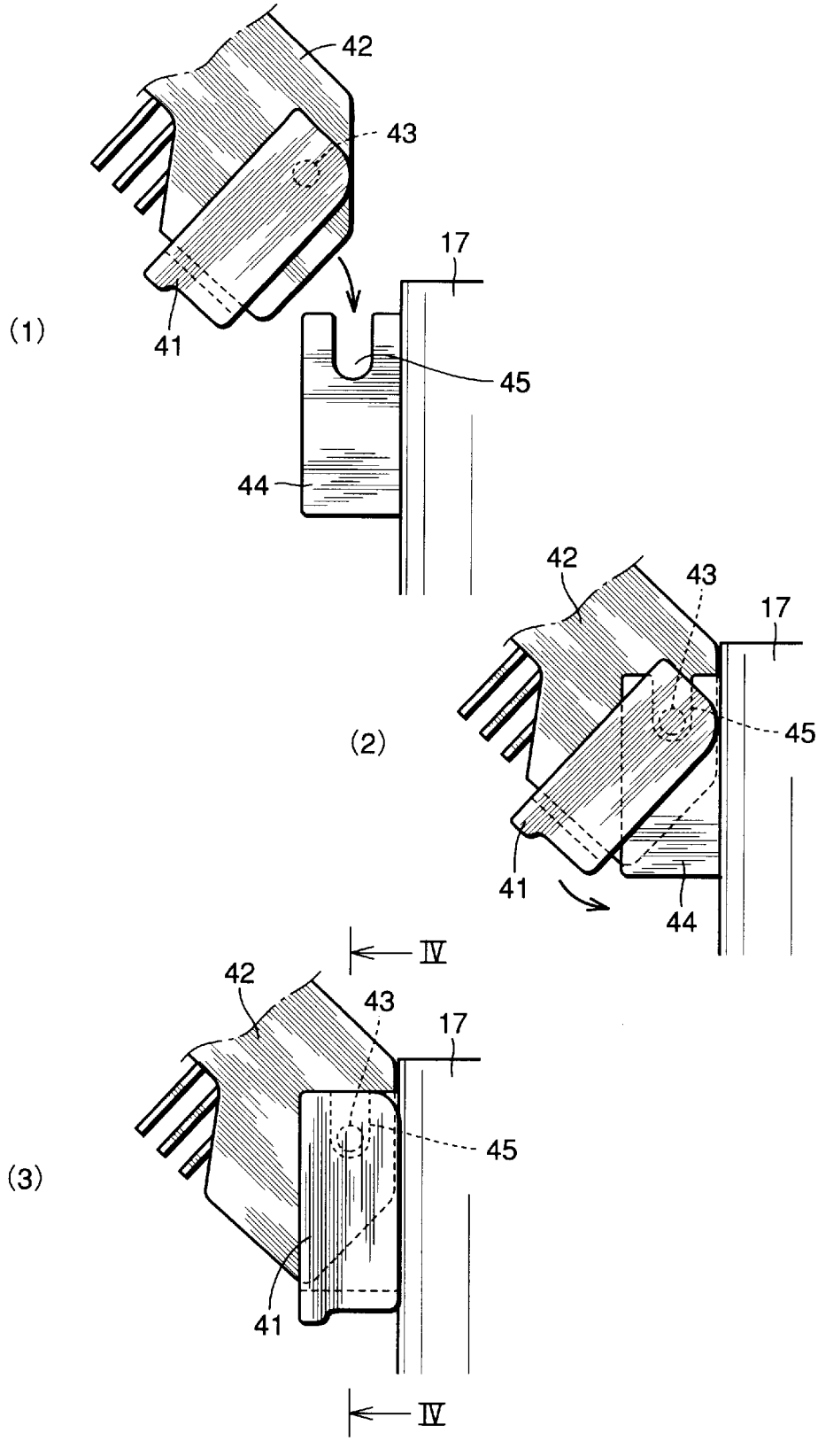
FIG. 3 is a diagram showing the structure for attaching/detaching a comb 14 to the housing 17 of the body 12 shown in FIG. 1.
Figure 4:
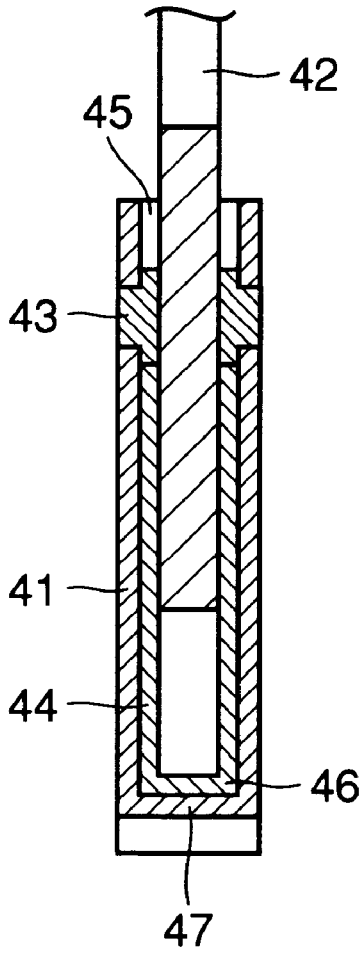
FIG. 4 is the sectional view taken along the line IV—IV in FIG. 3.

FIG. 3 is a diagram showing the structure for attaching/detaching the comb 14 to and from the housing 17 of the body 12 shown in FIG. 1, and FIG. 4 shows the cross section taken along the line IV—IV in FIG. 3.

Referring to the drawings, a projecting part 44 shaped like "U," in section is attached to the housing 17 as shown in FIG. 3; the projecting part 44 has cuts 45 in the upper ends of both side walls. A fitting member 41 shaped like "U" in section is attached in the vicinity of the end of the body of the comb, 42, which can be turned through the shaft 43.

As shown in FIG. 4, the fitting member 41 is sized and shaped so that it can be fitted closely over the outside of the projecting part 44. The cuts 45 of the projecting part 44 are sized and shaped so that the shaft 43 of the comb body 42 can be inserted therein from above.

When attaching the comb body 42 to the housing 17, the fitting member 41 is set in the position as shown in FIG. 3(1). Then, as shown in FIG. 3(2), the shaft 43 is fitted in the cuts 45 of the projecting part 44 from above. In this case, the fitting member 41 does not prevent the shaft 43 from fitting in the cuts 45 since the fitting member 41 is in the posture as shown in FIG. 3(1).

When the shaft 43 has been put in the cuts 45 of the projecting part 44, the shaft 43 abuts on the bottom of the cuts 45, so that the comb body 42 cannot move further downward. In this condition, the fitting member 41 is turned in the direction shown by the arrow shown in FIG. 3(2) and moved to the position shown in FIG. 3(3). In this condition, as shown in the sectional view of FIG. 4, the bottom of the fitting member 41 is positioned on the outside of the bottom of the projecting part 44, which prevents the fitting member 41 from moving upward.

In this way, the shaft 43 and the cuts 45 prevent the comb body 42 from moving down and the fitting member 41 and the projecting part 44 prevent it from moving up, thus firmly fixing it to the housing 17. Since the end of the comb body 42 on the side of the housing 17 abuts on the surface of the housing 17, the comb body 42 can be securely affixed to the housing 17 without turning on the housing 17. When removing the comb body 42 from the housing 17, the fitting member 41 is turned from the position of FIG. 3(3) to the position of FIG. 3(2), and then the comb body 42 is pulled out upward.

Figure 5:
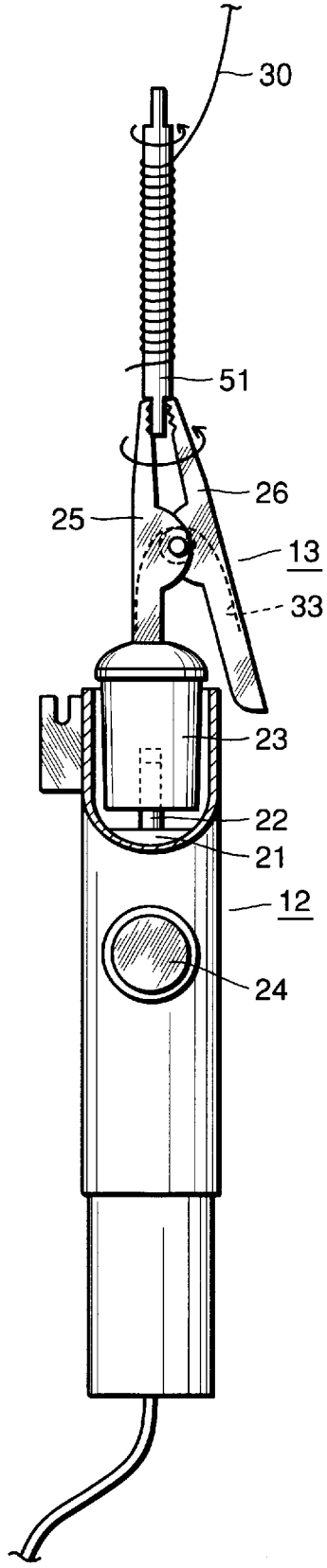
FIG. 5 is a diagram schematically showing the structure of a hair winding device for use in hair permanent process according to a second embodiment of the invention.

FIG. 5 is a diagram schematically showing the structure of a hair winding device for use in hair permanent process according to a second embodiment of the invention.

Referring to the drawing, the body 12 and the clip 13 have the same structure as those shown in the first embodiment. In this embodiment, the first holding member 25 and the second holding member 26 forming the clip 13 hold a rod 51 between their respective ends, instead of directly holding the hair 30. When the switch 24 on the body 12 is turned on in this condition, the clip 13 turns in the direction shown by the arrow. Then the rod 51 attached to the end of the clip 13 also turns in the direction shown by the arrow. When the rod 51 rotates with the end of several tens of threads of hair 30 to be processed wound on the rod 51 in an oblique direction near the clip 13, the hair 30 is spirally wound on the rod 51 as shown in the diagram. In this way, special hairdressing like spring permanent that requires winding the hair in small spirals can be automatically performed with a stable winding diameter.

Figure 6:
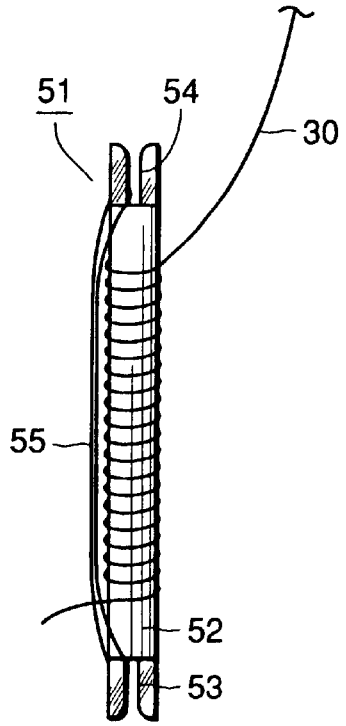
FIG. 6 is a diagram showing the rod 51 of FIG. 5 with hair wound on it.
Figure 7:
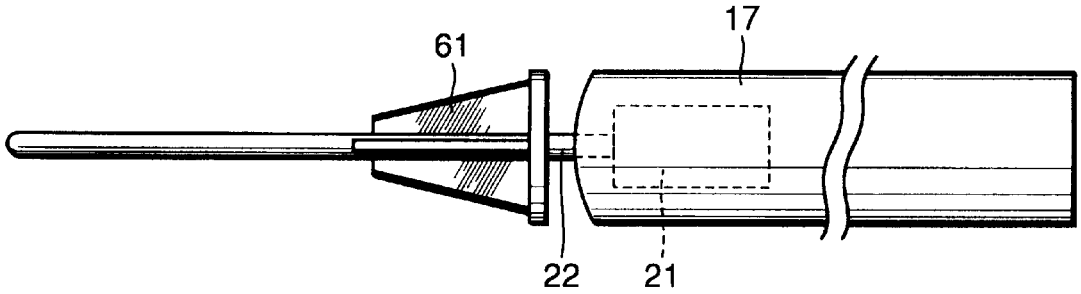
FIG.7 Prior Art
FIG. 7 is a diagram schematically showing the structure of a conventional hair winding device for use in hair permanent process.
Figure 8:
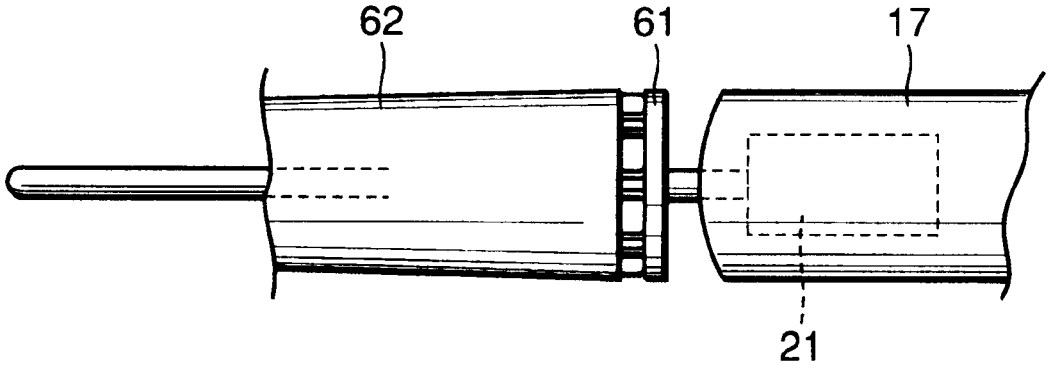
FIG.8 Prior Art
FIG. 8 is a diagram showing the hair winding device of FIG. 7 with a rod attached to it.
Figure 9:
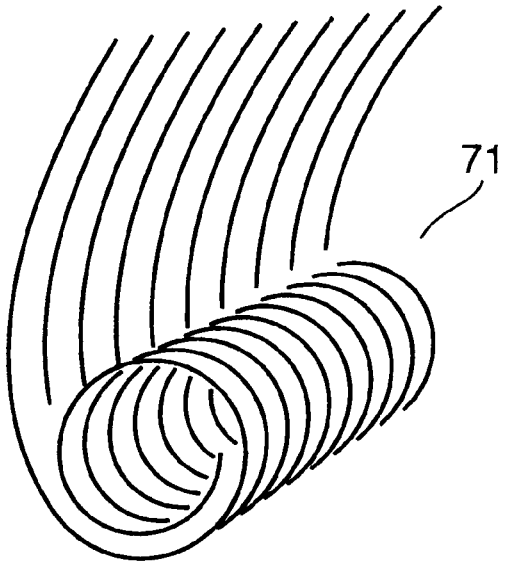
FIG. 9 is a diagram schematically showing a common wave formed by a cold permanent.
Figure 10:
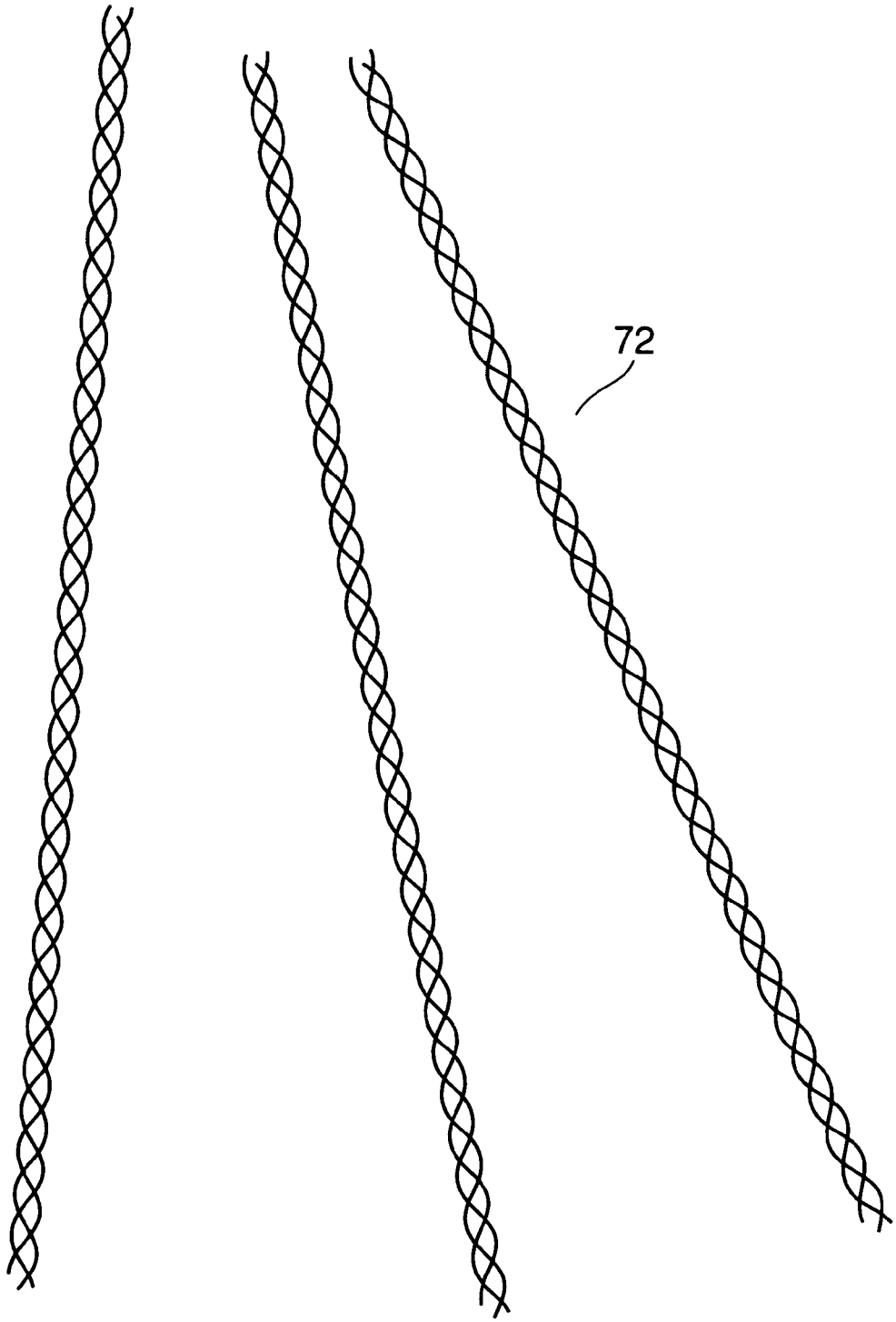
FIG. 10 is a diagram schematically showing a form formed by a common spiral permanent.

FIG. 6 is a diagram showing the rod 51 removed from the clip 13 after the hair 30 has been wound on the rod 51 with the hair winding device of FIG. 5.

Referring to the diagram, the body 52 of the rod 51 has a cut 53 and a cut 54 on both its ends as shown in the diagram. After the hair 30 has been wound on the body 52, a rubber 55 etc. is set across the cut 53 and the cut 54 to prevent the hair 30 from loosing. Thus the hair can be kept in the wound state and the permanent process can be performed in a stable manner.

Conventionally, the elaborate work of spirally winding the hair has been carried out by hand. However, using the rod 51 with the perm-dressing hair winding device allows even unskilled persons to make stable windings in a shorter time.

While the perm-dressing hair winding device 11 and the rotation controller 35 are constructed as separate units in the embodiments above, they can be formed as an integral unit.

Further, while the comb 14 is detachably attached to the perm-dressing hair winding device 11 in the embodiments above, it is not always necessary to attach the comb 14 to the perm-dressing hair winding device 11.

While the invention has been described in detail, the foregoing description is in all aspects illustrative and not restrictive. It is understood that numerous other modifications and variations can be devised without departing from the scope of the invention.

What is claimed is:

1. A hair winding device for use in a hair permanent process, comprising:

a slim rod, the rod having a slot in each of two opposite ends;

a clip removably holding one of the two ends of the rod; and rotating means rotating the clip and the held rod therewith about a longitudinal axis of the rod so as to spirally wind hair to be processed, on the rod.

2. The hair-winding device according to claim 1, wherein the rotating means includes a motor.

3. The hair-winding device according to claim 1, wherein the rod has a slot receiving portion at each of the two ends, and a hair winding portion about which the hair is spirally wound, the hair winding portion only between the slot receiving portions, the slot receiving portions having respective slots cut therein from the ends of the rod first distances in the longitudinal direction, the hair winding portion having a length extending in the longitudinal direction a second distance greater than the first distances.

4. A hair winding device for use in a hair permanent process, comprising:

a slim rod extending in a longitudinal direction, the rod having a slot in each of two opposite ends;

a clip removably holding one of the two ends of the rod;

rotating means rotating the clip and the held rod therewith about a longitudinal axis of the rod so as to spirally wind hair to be processed, on the rod; and an elastic band engagable with the slots in the opposite ends of the rod for holding the wound hair in place.

5. The hair-winding device according to claim 4, wherein the rotating means includes a motor.

6. The hair-winding device according to claim 4, wherein slots cut into the ends of the rod in the longitudinal direction.

7. The hair-winding device according to claim 6, wherein the rod has a slot receiving portion at each of the two ends, and a hair winding portion about which the hair is spirally wound, the hair winding portion only between the slot receiving portions, the slot receiving portions having the respective slots cut therein first distances from the ends of the rod, the hair winding portion having a length extending in the longitudinal direction a second distance greater than the first distances.

8. The hair winding device according to claim 4, wherein the rod has a cylindrical rod central portion and rod end portions at the opposite ends, the rod end portions each having flat parallel opposite sides, the sides extending in the longitudinal direction, the sides being separated from each other by a distance less than a diameter of the rod central portion.

9. A hair winding device for use in a hair permanent process, comprising:

a slim rod extending in a longitudinal direction, the rod having a cylindrical central portion and two opposite rod end portions, the rod end portions each having flat parallel opposite sides, the sides extending in the longitudinal direction, the rod end portions each having a slot cutting into the rod end portion in the longitudinal direction;

a clip removably holding one of the two end rod end portions;

rotating means, including a motor, rotating the clip and the held rod therewith about a longitudinal axis of the rod so as to spirally wind hair to be processed, on the rod; and an elastic band engagable with the slots for holding the wound hair in place on the rod.

10. The hair winding device according to claim 9, wherein the sides of the rod end portions are separated from each other by a distance less than a diameter of the rod central portion.

11. The hair-winding device according to claim 10, wherein the slots cut into the rod end portions from the ends of the rod first distances in the longitudinal direction, the central portion having a length extending in the longitudinal direction a second distance greater than the first distances, the elastic band holding the wound hair in place only on the central portion of the rod.

* * * * *